US007048635B1

(12) United States Patent
Porper

(10) Patent No.: US 7,048,635 B1
(45) Date of Patent: May 23, 2006

(54) FOLDING POOL CUE

(76) Inventor: Joseph Porper, 9142-44 Jordan Ave., Chatsworth, CA (US) 91311

( * ) Notice: Subject to any disclaimer, the term of this patent is extended or adjusted under 35 U.S.C. 154(b) by 0 days.

(21) Appl. No.: 11/078,080

(22) Filed: Mar. 10, 2005

(51) Int. Cl.
*A63D 15/08* (2006.01)

(52) U.S. Cl. ..... 473/44

(58) Field of Classification Search ..... 473/44–49
See application file for complete search history.

(56) References Cited

U.S. PATENT DOCUMENTS

| | | | | |
|---|---|---|---|---|
| 970,172 | A | 9/1910 | Bloom et al. | |
| 3,655,297 | A | 4/1972 | Bolen, Jr. et al | |
| 4,231,574 | A | 11/1980 | Williams | |
| 4,527,579 | A | 7/1985 | Knotter et al. | |
| 5,326,329 | A * | 7/1994 | Doss | 473/47 |
| 5,518,455 | A | 5/1996 | Costain et al. | |
| 5,527,224 | A | 6/1996 | Costain et al. | |
| 5,890,966 | A | 4/1999 | Costain et al. | |
| 6,027,410 | A | 2/2000 | Costain et al. | |
| 6,227,980 | B1 | 5/2001 | Costain et al. | |
| 6,348,006 | B1 | 2/2002 | Costain et al. | |

FOREIGN PATENT DOCUMENTS

| | | | |
|---|---|---|---|
| GB | 000000802 A | * | 1/1908 |
| GB | 2276825 A | * | 10/1994 |

OTHER PUBLICATIONS

Web-site information: www.patentec.com/data/class/135.html re US Patent Class 135—Tent, Canopy, Umbrella, or Cane (pp. 1-6).

* cited by examiner

*Primary Examiner*—Mark S. Graham
(74) *Attorney, Agent, or Firm*—Kelly Lowry & Kelley, LLP

(57) ABSTRACT

A pool cue foldable between storage and use configurations includes first and second tapered rods each having first and second ends which are disposed adjacent to one another in the storage configuration. The second end of the first tapered rod is disposed adjacent the first end of the second tapered rod in the use configuration. A hinge pivotally connects the first and second tapered rods.

20 Claims, 6 Drawing Sheets

FOLDING POOL CUE

BACKGROUND OF THE INVENTION

The present invention generally relates to pool cues. More particularly, the present invention relates to a folding pool cue.

A cue stick used for playing table games such as pool, billiards and the like is a single piece stick that tapers from a butt end to an operative end for striking a cue ball. For players who enjoy using their own cue stick wherever they play, bringing a single piece cue stick from place to place is problematical as the relatively long stick could be difficult to place in a vehicle trunk or passenger space without incurring damage to the cue stick during placement within the vehicle or from jarring during travel. To this end, some players use a two piece cue stick having an operative end shaft portion and a butt end shaft portion which are assembled together for use or disassembled for transportation between locations. These two portions of the cue stick are mated together by a threaded female bore in one of the portions that engages a male threaded rod in the other portion. The two portions are screwed together until the ends of the portions contact each other.

The two piece cue stick has been gaining popularity with serious players. Some have recognized the desirability of providing a quick and easy way to connect the two pieces of the cue stick together. For example, U.S. Pat. No. 5,890,966 discloses a quick coupling cue stick. It is believed, however, that such a cue stick is inefficient in assembly as the two independent parts of the cue stick must first be aligned before they can be joined.

Accordingly, there is a need for a multi-piece cue stick which provides easy disassembly for travel/storage and easy reassembly for use. There is a further need for a multi-piece cue stick which automatically aligns during assembly for use. There is an additional need for a multi-piece cue stick foldable between storage and use configurations. The present invention fulfills these needs and provides other related advantages.

SUMMARY OF THE INVENTION

The present invention is useful in a variety of ways. The cue stick embodying the present invention provides easy disassembly for travel/storage and easy reassembly for use. The cue stick is foldable between storage and use configurations and automatically aligns during assembly for use.

In an embodiment of the present invention, a pool cue foldable between storage and use configurations includes first and second tapered rods each having first and second ends which are disposed adjacent to one another in the storage configuration. The second end of the first tapered rod is disposed adjacent the first end of the second tapered rod in the use configuration. A hinge pivotally connects the first and second tapered rods.

At least one of the first and second tapered rods includes a central bore in which the hinge is disposed when pool cue is in the use configuration.

The hinge includes first and second rod engaging members connected to, respectively, the first and second tapered rods. The hinge has a central link connecting the first and second rod engaging members. At least one of the first and second rod engaging members is pivotally connected to the central link. The first and second rod engaging members are offset and generally parallel to one another in the storage configuration and coaxial in the use configuration of the pool cue. At least one of the first and second rod engaging members engages a central bore of at least one of the first and second tapered rods. At least one of the first and second rod engaging members engages a sleeve bushing disposed within a central bore of at least one of the first and second tapered rods.

The pool cue includes means for locking the first and second tapered rods in the use configuration. The locking means includes a threaded connection between the first and second tapered rods.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
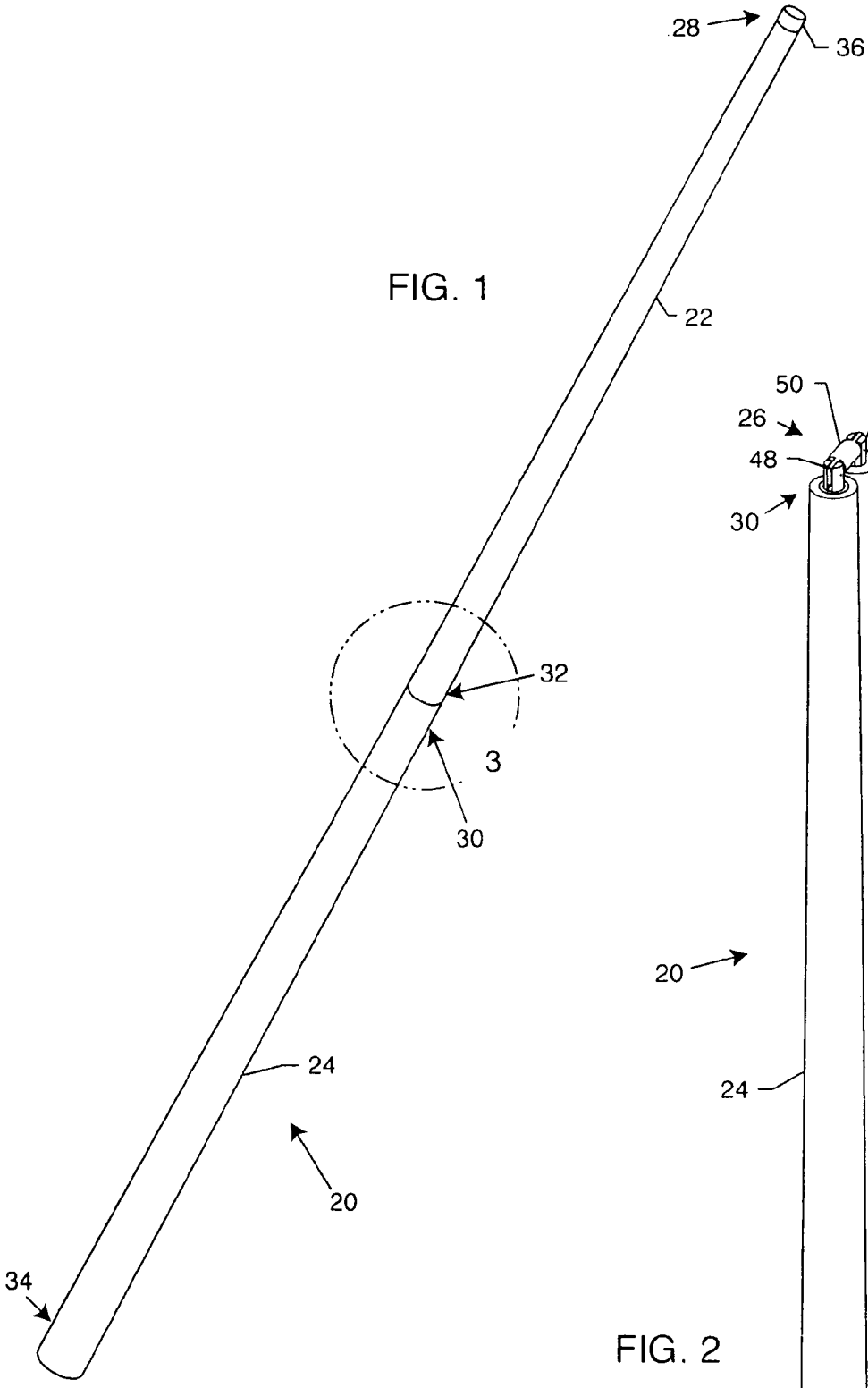
FIG. 1 is a perspective view of a two piece cue stick embodying the present invention in a use configuration.
Figure 2:
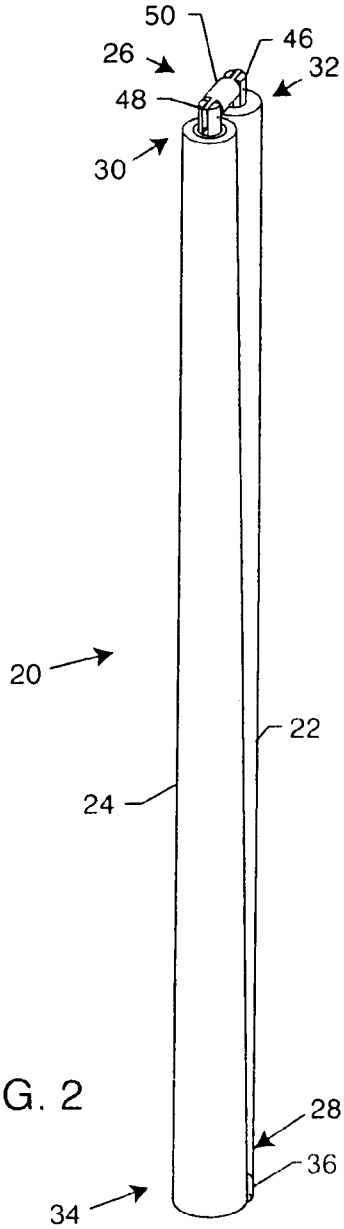
FIG. 2 is a perspective view of a two piece cue stick embodying the present invention folded in a storage configuration.
Figure 3:
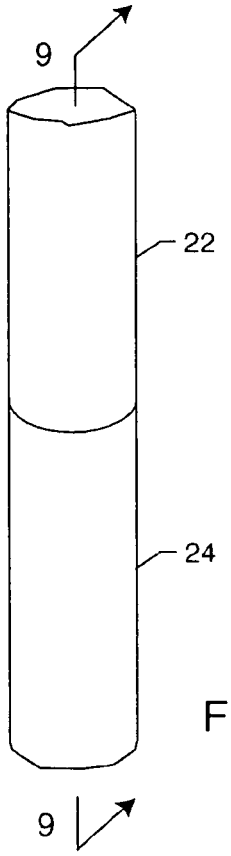
FIG. 3 is an enlarged perspective view of the cue stick of FIG. 1 taken along line 3 of FIG. 1 showing a portion of the cue stick where the two pieces of the cue stick join.
Figure 4:
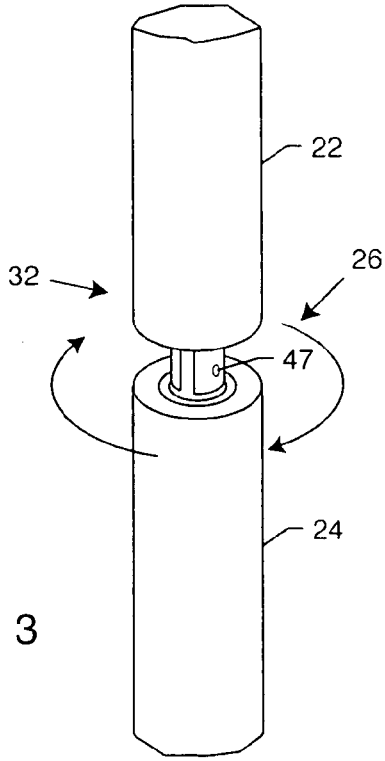
FIG. 4 is a view of the portion of the cue stick of FIG. 3 that illustrates the two pieces of the cue stick as the threaded connection between the two pieces is disengaged with one piece of the cue stick being rotated relative to the other piece.
Figure 5:
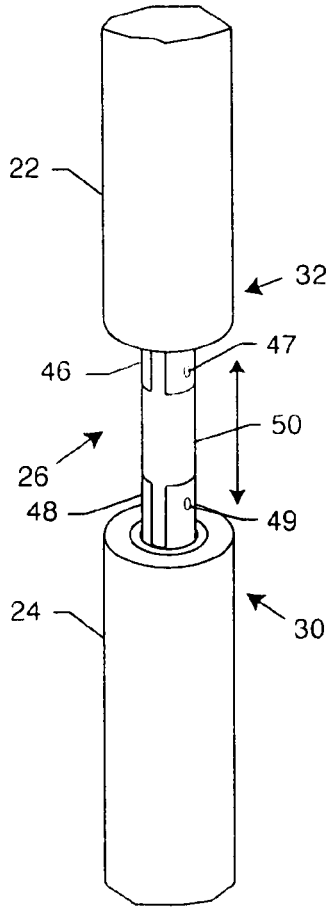
FIG. 5 is a view of the portion of the cue stick of FIG. 4 that illustrates the two pieces of the cue stick being separated from one another by being linearly moved in opposite directions.
Figure 6:
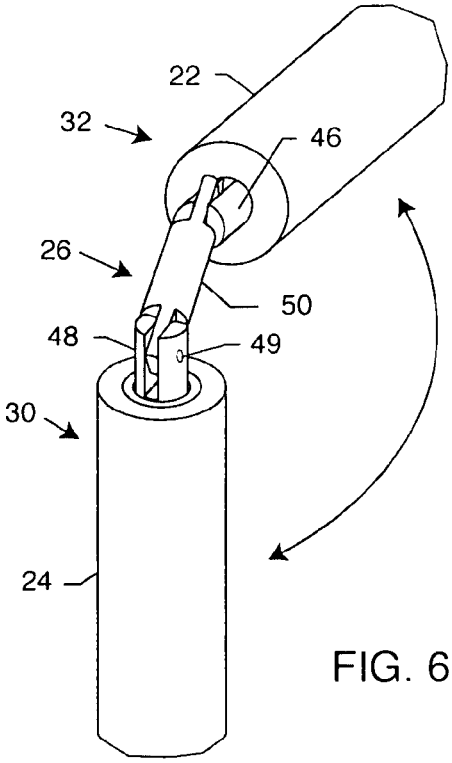
FIG. 6 is a view of the portion of the cue stick of FIG. 5 that illustrates the two pieces of the cue stick being folded relative to one another along the pivots of the hinge connecting the two pieces.
Figure 7:
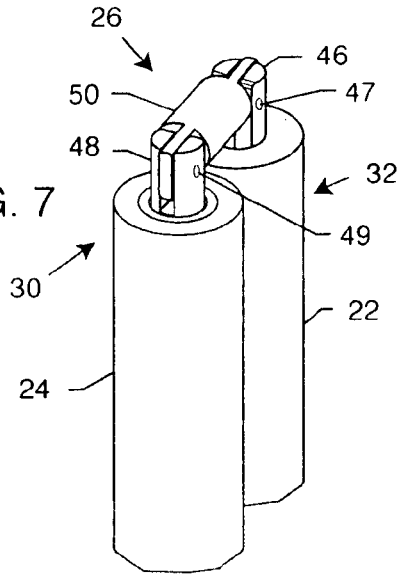
FIG. 7 is a view of the portion of the cue stick of FIG. 5 with the two pieces of the cue stick folded into the storage position.

As shown in the accompanying drawings for purposes of illustration, the present invention resides in a folding cue stick, generally referred to by the reference number 20. The cue stick 20 is designed to fold between storage and use configurations. As the pieces of the cue stick are always connected to one another, there is no need to align the pieces for assembly once the two pieces have been folded to the use configuration as the folding automatically aligns the pieces for engagement with one another. The present invention provides a foldable cue stick that can be reduced to a highly compact, storage configuration and returned to a use configuration almost effortlessly by the user. The hinge provides sturdy connections for the pieces of the cue stick 20 to resist unintentional collapsing of the cue stick 20. Additionally, the hinge design allows the hinge to blend with the pieces of the cue stick 20 to present a trim appearance.

With reference now to FIGS. 1–11, the cue stick 20 is a generally cylindrical stick that tapers in diameter along its length. The cue stick 20 includes first and second tapered rods 22, 24. A hinge 26 pivotally connects the first and second tapered rods 22, 24 together. Each rod 22, 24 has a first end 28, 30 and a second end 32, 34. The first end 28 of the first tapered rod 22 has a cushioned tip 36 for striking a cue ball (not shown). The second end 34 of the second tapered rod 24 serves as the butt end of the cue stick 20. The second end 34 of the second tapered rod 24 has the largest diameter of the cue stick 20 while the first end 28 of the first tapered rod 22 has the smallest diameter of the cue stick 20. The rods 22, 24 are disposed adjacent to one another along their sides 38, 40 in the storage configuration but the second end 32 of the first tapered rod 22 is disposed adjacent the first end 30 of the second tapered rod 24 in the use configuration. The diameters of the cue stick 20 at the second end 30 of the first tapered rod 22 and the first end 30 of the second tapered rod 24 are approximately equal. While the cue stick 20 described above has two sections (i.e., first and second tapered rods 22, 24), the cue stick 20 may also have three or more sections of tapered rods. The sections of the cue stick 20 are preferably made from wood, but may also be made from metal or a graphite composite material. The first and second tapered rods 22, 24 are preferably the same length.

A central bore 42 is made in the first tapered rod 22 at the second end 30 and a central bore 44 is made in the second tapered rod 24 at the first end 30. The hinge 26 is positioned within these bores 42, 44 in both the use and storage configurations to pivotally connect the first and second tapered rods 22, 24. In the use configuration, the hinge 26 is completely hidden from sight within the rods 22, 24.

The hinge 26 includes first and second rod engaging members 46, 48 connected to, respectively, the first and second tapered rods 22, 24. The hinge 26 also includes a central link 50 disposed between the first and second rod engaging members 46, 48. The first and second rod engaging members 46, 48 are each pivotally connected to the central link 50 by their respective pivot pins 47, 49 which extend through apertures in the link 50 and members 46, 48. When unfolded to the use configuration, the rods 22, 24 of the cue stick 20 are axially aligned as are the components of hinge 26. The hinge components 46, 48, 50 are made from various materials including, without limitation, metal, high strength plastic and the like.

The first and second rod engaging members 46, 48 are pivotally connected to the central link 50 in such a manner that each of the rod engaging members 46, 48 is only able to pivot ninety degrees in the same direction as the other rod engaging member 46, 48. The first and second rod engaging members 46, 48 are offset and generally parallel to one another in the storage configuration, and coaxial in the use configuration of the cue stick 20. Each rod engaging member 46, 48 operatively engages the respective central bore 42, 44 the first and second tapered rods 22, 24. The central link 50 and rod engaging members 46, 48 provide a generally cylindrical cross-section in the use configuration. In this manner, the first and second rod engaging members 46, 48 are displaced laterally from a longitudinal axis 52 of the hinge 26 in a manner to permit the two rods 22, 24 to lie alongside of and parallel to each other 22, 24 in the position shown in FIG. 7 and generally perpendicular to the longitudinal axis 52 of the hinge 26. Upper outer threads 54 of a sleeve bushing 56 disposed within the central bore 44 of the second rod 24 engage threads 58 of the central bore 44.

Figure 9:
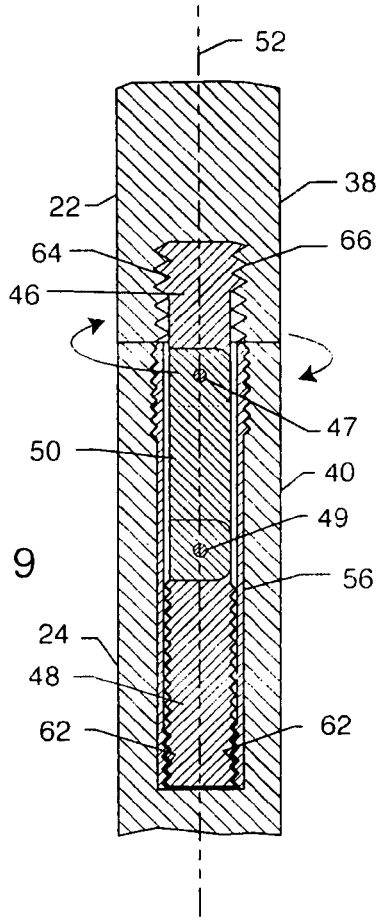
FIG. 9 is a cross-sectional view of the portion of the cue stick of FIG. 3 that illustrates the two pieces of the cue stick as the threaded connection between the two pieces is disengaged with one piece of the cue stick being rotated relative to the other piece.
Figure 11:
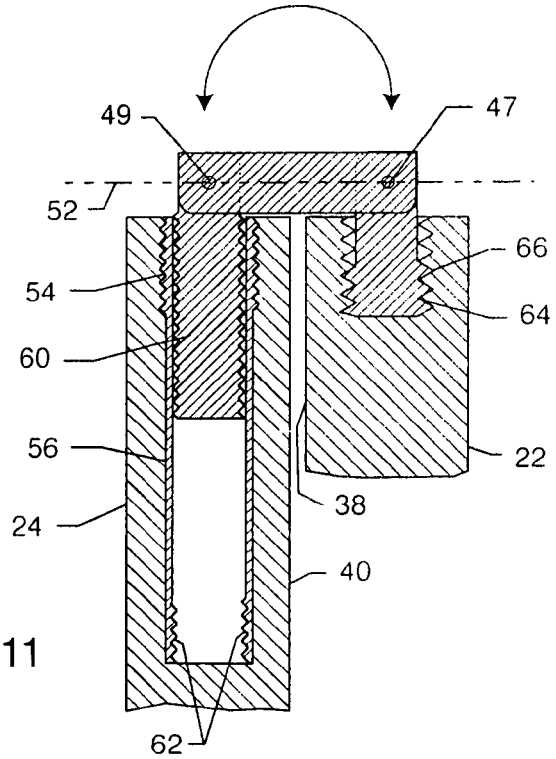
FIG. 11 is a cross-sectional view of the portion of the cue stick of FIG. 7.

A threaded portion 60 of the second rod engaging member 48 engages lower inner threads 62 of the sleeve bushing 56 when the cue stick 20 is in the use configuration shown in FIG. 9. The engagement of the threaded portion 60 of the second rod engaging member 48 and the threads 62 of the sleeve bushing 56 locks the first and second tapered rods 22, 24 in the use configuration. In the use configuration, the central link 50 is disposed within the sleeve bushing 56. In both the use and storage configurations, a threaded portion 64 of the first rod engaging member 46 engage threads 66 of the central bore 42 of the first tapered rod 22.

Figure 8:
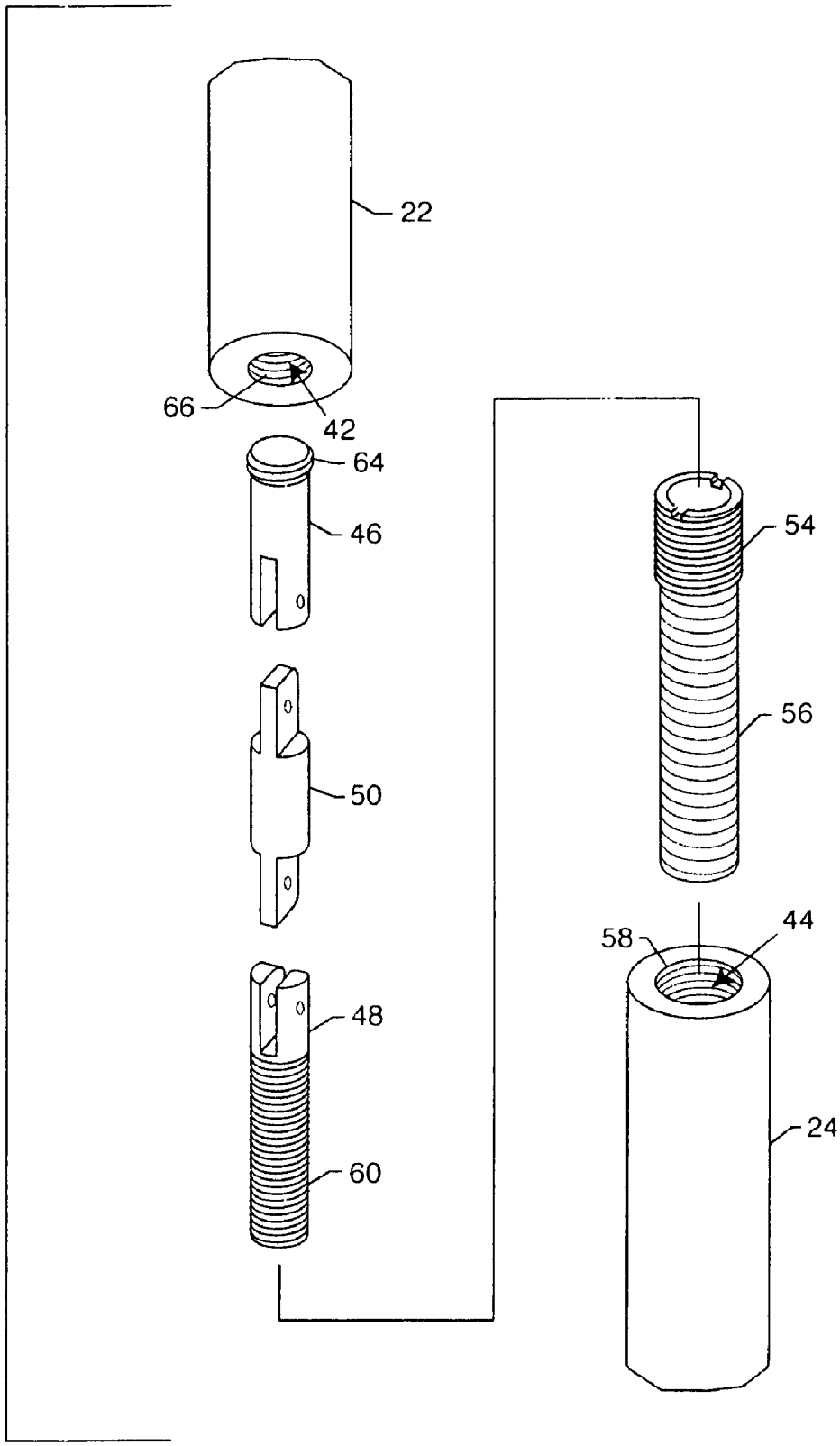
FIG. 8 is an exploded view of the portion of the cue stick of FIG. 3 that illustrates the hinge and the respective bores in the two pieces of the cue stick.
Figure 10:
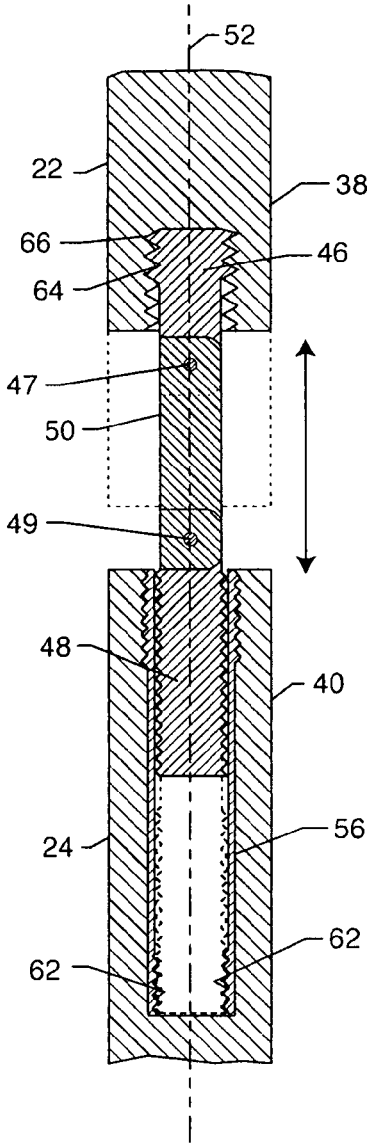
FIG. 10 is a cross-sectional view of the portion of the cue stick of FIG. 5.
Figure 12:
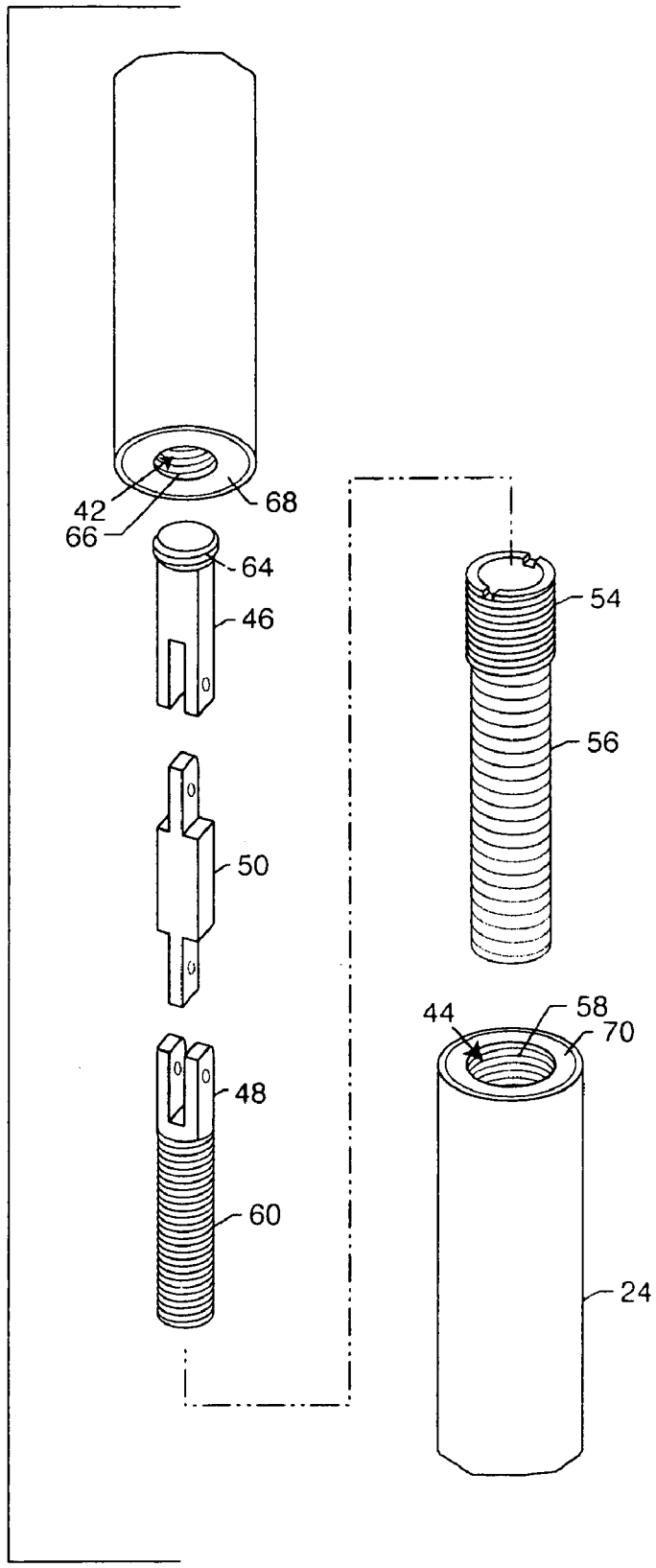
FIG. 12 is an exploded view of another embodiment of the portion of the cue stick of FIG. 3 that illustrates the hinge, the respective bores in the two pieces of the cue, and the inset magnets that surround the bores on the ends of the two pieces that abut.
Figure 13:
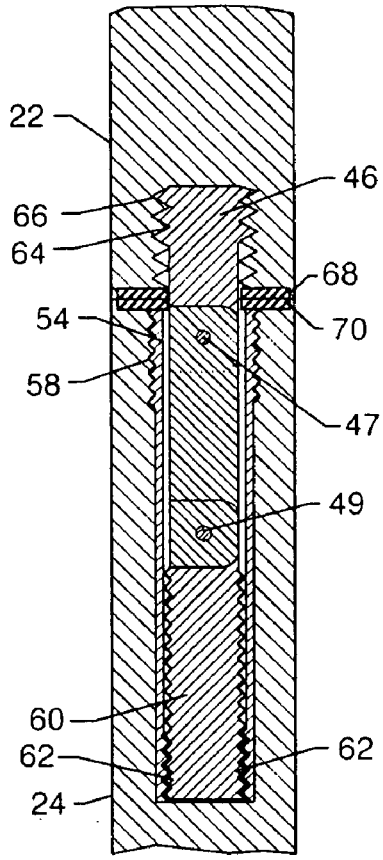
FIG. 13 is a cross-sectional view of the portion of the cue stick of FIG. 12 that illustrates the two pieces of the cue stick as the threaded connection between the two pieces is disengaged with one piece of the cue stick being rotated relative to the other piece.
Figure 14:
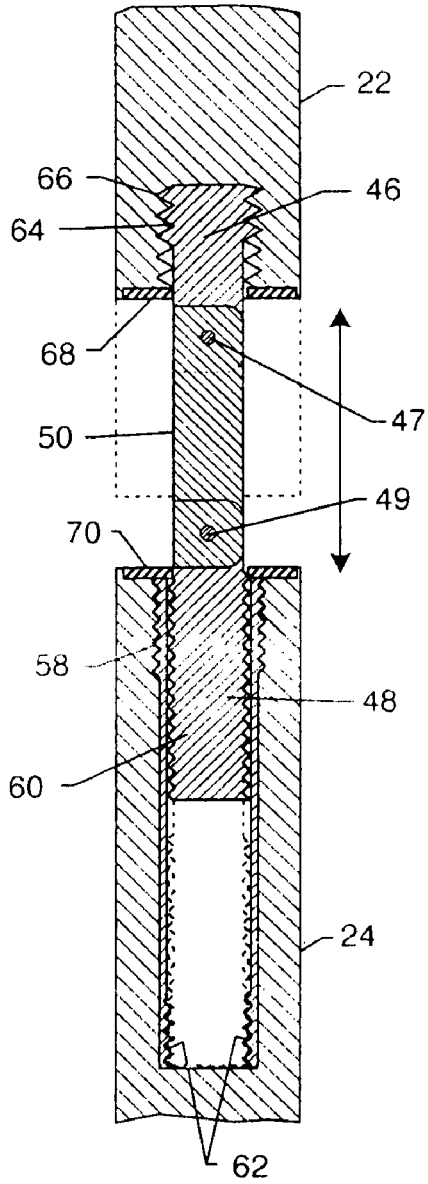
FIG. 14 is a cross-sectional view of the portion of the cue stick of FIG. 12 that illustrates the two pieces of the cue stick being separated from one another by being linearly moved in opposite directions after the disengagement of the two pieces shown in FIG. 13.

An alternative hinge embodiment, as shown in FIGS. 12–14, is similar to the hinge 26 of FIGS. 8–10 except that magnets 68, 70 are inset within the respective ends 32, 30 of the first and second tapered rods 22, 24 that are adjacent in the use configuration. The magnetic strength of these magnets 68, 70 lock the first and second tapered rods 22, 24 in the use configuration. In an alternative, a combination of magnets and threads can be used to lock the first and second tapered rods 22, 24 in the use configuration. In this alternative, the hinge 26 (i.e., central link 50 and rod engaging members 46, 48) provides a generally square cross-section in the use configuration except for threaded areas.

Although two embodiments of the invention have been described in detail for purposes of illustration, various modifications may be made to each without departing from the scope and spirit of the invention.

What is claimed is:

1. A pool cue foldable between storage and use configurations, comprising:

first and second tapered rods each having first and second ends and being disposed adjacent to one another in the storage configuration, and the second end of the first tapered rod disposed adjacent the first end of the second tapered rod in the use configuration; and a hinge pivotally connecting the first and second tapered rods.

2. The pool cue of claim 1, wherein at least one of the first and second tapered rods includes a central bore in which the hinge is disposed when pool cue is in the use configuration.

3. The pool cue of claim 1, wherein the hinge includes first and second rod engaging members connected to, respectively, the first and second tapered rods.

4. The pool cue of claim 3, wherein the hinge comprises a central link connecting the first and second rod engaging members.

5. The pool cue of claim 4, wherein at least one of the first and second rod engaging members is pivotally connected to the central link.

6. The pool cue of claim 4, wherein the first and second rod engaging members are offset and generally parallel to one another in the storage configuration, and coaxial in the use configuration of the pool cue.

7. The pool cue of claim 4, wherein at least one of the first and second rod engaging members engages a central bore of at least one of the first and second tapered rods.

8. The pool cue of claim 4, wherein at least one of the first and second rod engaging members engages a sleeve bushing disposed within a central bore of at least one of the first and second tapered rods.

9. The pool cue of claim 1, including means for locking the first and second tapered rods in the use configuration.

10. The pool cue of claim 9, wherein the locking means includes a threaded connection between the first and second tapered rods.

11. A pool cue foldable between storage and use configurations, comprising:

first and second tapered rods each having first and second ends and being disposed adjacent to one another in the storage configuration, and the second end of the first tapered rod disposed adjacent the first end of the second tapered rod in the use configuration;

a hinge pivotally connecting the first and second tapered rods; and means for locking the first and second tapered rods in the use configuration;

wherein at least one of the first and second tapered rods includes a central bore in which the hinge is disposed when pool cue is in the use configuration.

12. The pool cue of claim 11, wherein the hinge includes first and second rod engaging members connected to, respectively, the first and second tapered rods.

13. The pool cue of claim 12, wherein the hinge comprises a central link connecting the first and second rod engaging members.

14. The pool cue of claim 13, wherein at least one of the first and second rod engaging members is pivotally connected to the central link.

15. The pool cue of claim 13, wherein the first and second rod engaging members are offset and generally parallel to one another in the storage configuration, and coaxial in the use configuration of the pool cue.

16. The pool cue of claim 13, wherein at least one of the first and second rod engaging members engages a central bore of at least one of the first and second tapered rods, and at least one of the first and second rod engaging members engages a sleeve bushing disposed within a central bore of at least one of the first and second tapered rods.

17. The pool cue of claim 11, wherein the locking means includes a threaded connection between the first and second tapered rods.

18. A pool cue foldable between storage and use configurations, comprising:

first and second tapered rods each having first and second ends and being disposed adjacent to one another in the storage configuration, and the second end of the first tapered rod disposed adjacent the first end of the second tapered rod in the use configuration;

a hinge comprising a central link pivotally connected to first and second rod engaging members connected to, respectively, the first and second tapered rods; and means for locking the first and second tapered rods in the use configuration having a threaded connection between the first and second tapered rods;

wherein at least one of the first and second tapered rods includes a central bore in which the hinge is disposed when pool cue is in the use configuration, the first and second rod engaging members are offset and generally parallel to one another in the storage configuration, and wherein the first and second rod engaging members are coaxial in the use configuration of the pool cue.

19. The pool cue of claim 18, wherein at least one of the first and second rod engaging members is pivotally connected to the central link.

20. The pool cue of claim 18, wherein at least one of the first and second rod engaging members engages a central bore of at least one of the first and second tapered rods, and at least one of the first and second rod engaging members engages a sleeve bushing disposed within a central bore of at least one of the first and second tapered rods.

* * * * *